US009293856B2

(12) United States Patent
Shigeta et al.

(10) Patent No.: US 9,293,856 B2
(45) Date of Patent: Mar. 22, 2016

(54) CONNECTOR ASSEMBLY

(71) Applicant: Yazaki Corporation, Minato-ku, Tokyo (JP)

(72) Inventors: Yoshinori Shigeta, Kakegawa (JP); Koichi Nakayama, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/438,431

(22) PCT Filed: Nov. 11, 2013

(86) PCT No.: PCT/JP2013/080456

§ 371 (c)(1),
(2) Date: Apr. 24, 2015

(87) PCT Pub. No.: WO2014/077220

PCT Pub. Date: May 22, 2014

(65) Prior Publication Data

US 2015/0288090 A1 Oct. 8, 2015

(30) Foreign Application Priority Data

Nov. 13, 2012 (JP) ..... 2012-249021

(51) Int. Cl.
*H01R 13/42* (2006.01)
*H01R 13/52* (2006.01)

(52) U.S. Cl.
CPC ..... *H01R 13/5202* (2013.01)

(58) Field of Classification Search
CPC ..... H01R 101/00; H01R 13/4362
USPC ..... 439/738, 752, 695, 589, 587
See application file for complete search history.

(56) References Cited

U.S. PATENT DOCUMENTS 6,921,292 B2 * 7/2005 Miyazaki ..... H01R 9/032 439/564
7,097,498 B2 * 8/2006 Miyazaki ..... H01R 13/512 439/362

(Continued)

FOREIGN PATENT DOCUMENTS

JP 7-240253 A 9/1995
JP 8-312496 A 11/1996

(Continued)

OTHER PUBLICATIONS

Search Report dated Jan. 14, 2014 issued by the International Searching Authority in counterpart International Patent Application No. PCT/JP2013/080456 (PCT/ISA/210).

(Continued)

*Primary Examiner* — Phuongchi T Nguyen
(74) *Attorney, Agent, or Firm* — Sughrue Mion, PLLC

(57) ABSTRACT

A connector assembly includes a housing (1) in which a wire-side terminal (2) is held, and which is fitted to a mounting hole formed in a casing 5 of a mating device to be connected, and a sealing member (3) which is attached to a groove part (16) formed in an outer peripheral part (11) of the housing thereby to keep an interior of the casing liquid tight. The sealing member (3) includes a convex part (33) formed in a curved part thereof, by protruding in a width direction from its peripheral edge part in a shape of an 10 annularly continued band. The groove part (16) includes a concave part (18) formed by denting a groove wall (16b), corresponding to the convex part (33). The convex part (33) and the concave part (18) are engaged with each other.

2 Claims, 2 Drawing Sheets

(56) References Cited

U.S. PATENT DOCUMENTS

| | | | | |
|---|---|---|---|---|
| 2002/0048994 | A1* | 4/2002 | Oota | H01R 13/5205 439/98 |
| 2004/0106325 | A1 | 6/2004 | Miyazaki | |
| 2004/0266270 | A1 | 12/2004 | Miyazaki | |

FOREIGN PATENT DOCUMENTS

| | | | |
|---|---|---|---|
| JP | 2004-172009 | A | 6/2004 |
| JP | 2005-19319 | A | 1/2005 |
| JP | 2009-104837 | A | 5/2009 |
| JP | 2011-60451 | A | 3/2011 |

OTHER PUBLICATIONS

Written Opinion dated Jan. 14, 2014 issued by the International Seraching Authority in counterpart International Patent Application No. PCT/JP2013/080456 (PCT/ISA/237).

English translation of Written Opinion dated Jan. 14, 2014 issued by the International Searching Authority in counterpart International Patent Application No. PCT/JP2013/080456 (PCT/ISA/237).

* cited by examiner (a)

(b)

(a)

(b)

(c)

CONNECTOR ASSEMBLY

TECHNICAL FIELD

The present invention relates to a connector assembly for interconnecting terminals.

BACKGROUND ART

A vehicle such as an electric car which runs using an electric motor, and a hybrid car which runs using both an engine and an electric motor, is driven by an electric power which is supplied to the electric motor from a power supply mounted on the vehicle. In the hybrid car, for example, the electric motor and an inverter are connected to each other by an electric wire such as a motor cable. Moreover, the inverter is connected to an electric junction box (a junction box) which is provided in the power supply, and thus, the electric power is supplied from the power supply to the electric motor. On this occasion, the inverter and the electric junction box are connected to each other by way of a given connector member (a connector assembly).

As an example of the connector assembly as described above, there has been known the connector assembly having such a structure that a mounting hole is formed in a casing of the inverter or the electric junction box, a device-side terminal is provided in the casing, a wire-side terminal which is connected to a plurality of electric wires is held in a housing, and this housing is fitted to the mounting hole, thereby to connect the wire-side terminal to the device-side terminal (refer to Patent Literature 1). In the connector assembly having such a structure, a sealing member is attached to a groove part of the housing. In this manner, in a state where the housing is fitted to the mounting hole, a part between the groove part of the housing and an inner peripheral part of the mounting hole is sealed by the sealing member, and an interior of the casing is maintained in a liquid tight state.

In this case, the device-side terminal and the wire-side terminal are arranged laterally in a row, and according to such arrangement, both the housing and the mounting hole of the casing are formed in a laterally elongated elliptical shape (that is, a non-circular shape), as a whole. For this reason, also the sealing member which is attached to the housing is not formed in a circular shape, but formed in an elliptical shape. Therefore, when the sealing member is displaced with respect to the housing in a circumferential direction, there is an anxiety of such trouble that a part of the sealing member is lifted from the groove part of the housing or excessively expanded. In case where the sealing member is attached in this state, when the housing is fitted to the mounting hole, tight contact of the sealing member with respect to the groove part of the housing and the inner peripheral part of the mounting hole is not uniformly performed in the circumferential direction, and hence, deterioration of sealing performance is incurred.

For the purpose of eliminating the above described trouble, Patent Literature 1 discloses an example of the connector assembly having such a structure that the sealing member is provided with a lock part (a convex part), while the housing is provided with a regulating part (a concave part), and the lock part and the regulating part are engaged with each other, so that the sealing member is positioned with respect to the housing in the circumferential direction, and rotation of the sealing member in the circumferential direction with respect to the housing is also prevented.

CITATION LIST

Patent Literature

Patent Literature 1: JP-A-2004-172009

SUMMARY OF INVENTION

Technical Problem

However, in the connector assembly disclosed in Patent Literature 1, the lock part and the regulating part are engaged with each other in a longitudinal direction (that is, a direction in which the housing is fitted to the mounting hole). For this reason, there is such anxiety that although a force in the longitudinal direction can be exerted on the sealing member, a force in the circumferential direction cannot be sufficiently exerted. Therefore, when the housing is fitted to the mounting hole, in case where a worker happens to touch the sealing member and the force in the circumferential direction is exerted by mistake, such possibility that the sealing member is rotated in the circumferential direction with respect to the housing cannot be excluded, according to degree of the force. As results, there is such anxiety that the sealing member runs upon the housing, and when the housing is fitted to the mounting hole, the sealing member is entangled, causing damage such as a break.

The present invention has been made in view of the above described problem, and an object of the present invention is to enhance sealing performance in a connector assembly, by reliably restraining rotation of a sealing member with respect to a housing in a circumferential direction.

Solution to Problem

The above described object of the present invention is attained by the following configurations.

(1) A connector assembly in which a wire-side terminal provided on an end portion of an electric wire is electrically connected to a device-side terminal provided on a mating device to which the electric wire is connected, the connector assembly including a housing in which the wire-side terminal is held, and which is fitted to a mounting hole formed in a casing of the mating device, and a sealing member which is fitted to a groove part formed by denting an outer peripheral part of the housing along its entire circumference, and interposed between the groove part and an inner peripheral part of the mounting hole for keeping an interior of the casing liquid tight, wherein the sealing member is formed in a shape of an annularly continued band, and provided with a convex part which is formed in a curved part thereof, by protruding from at least one peripheral edge in a width direction, and the groove part includes a concave part which is formed by denting at least one of groove walls which are opposed to each other interposing a groove bottom in correspondence with the convex part, and the convex part and the concave part are so formed to be engaged with each other in a direction along the curved part of the sealing member.

According to the connector assembly having the structure as described above in the configuration (1), in case where a force in the circumferential direction is exerted on the sealing member, this force can be reliably loaded by engagement between the convex part and the concave part. Therefore, for example, even in such a case that a worker happens to touch the sealing member at a time of fitting the connector assembly to the mounting hole of the mating device to be connected, and the force in the circumferential direction is exerted on the sealing member, it is possible to effectively prevent rotation of the sealing member in the circumferential direction with respect to the housing.

(2) A connector assembly having the structure as described above in the configuration (1), wherein the convex part includes a convex engaging end which is tapered in a direction where the convex part is engaged with the concave part, and the concave part includes a concave engaging end which is tapered in a direction where the convex part is engaged with the concave part.

According to the connector assembly having the structure as described above in the configuration (2), it is possible to smoothly and reliably engage the convex part and the concave part with each other, and it is also possible to keep them in an engaged state.

DESCRIPTION OF EMBODIMENTS

A connector assembly according to the present invention will be described below, referring to the attached drawings. The connector assembly according to the present invention is an interface member for electrically interconnecting (specifically, electrically connecting and disconnecting) a wire-side terminal provided on an end portion of an electric wire and a device-side terminal provided on a mating device to be connected. Uses of the connector assembly are not particularly limited. For example, it is possible to suppose, as an appropriate example, such a case that an inverter of an electric motor which is mounted on a vehicle such as an electric car driven using the electric motor, a hybrid car driven using both an engine and the electric motor is connected to an electric junction box (a junction box) of a power supply device for supplying an electric power to the electric motor.

Figure 1:
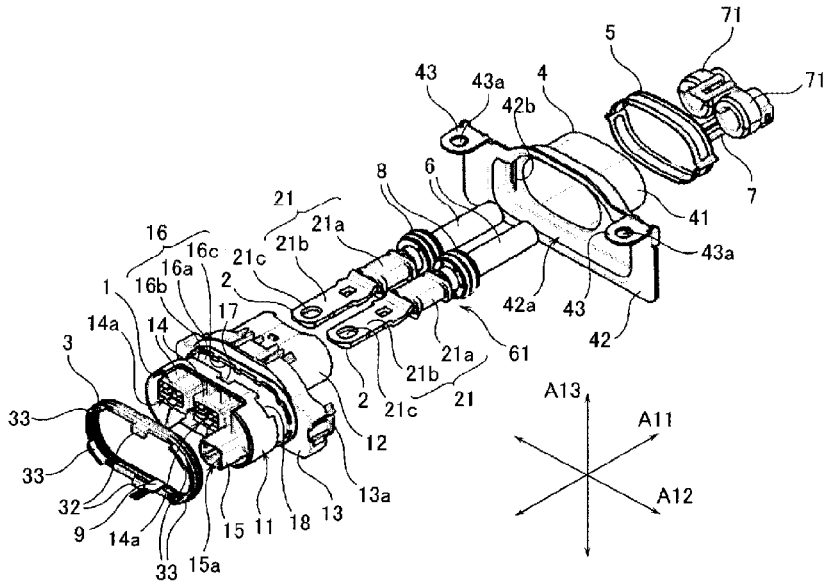
In FIG. 1, (*a*) and (*b*) are diagrams showing an entire structure of a connector assembly according to an embodiment of the present invention, in which FIG. 1(*a*) is a perspective view of the connector assembly which is exploded into constituent members, and FIG. 1(*b*) is a perspective view showing the entire structure in a state where the constituent members as shown in FIG. 1(*a*) are assembled.
Figure 1:
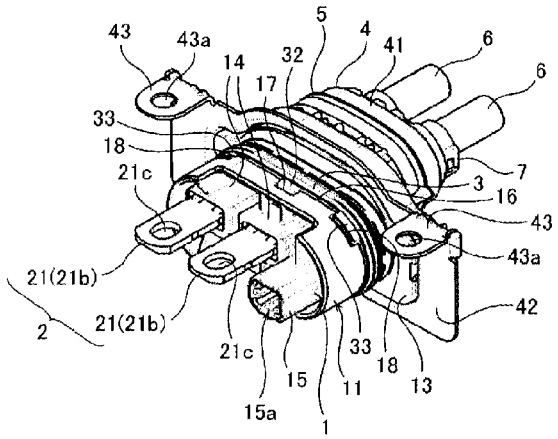

FIGS. 1(*a*) and 1(*b*) are diagrams showing an entire structure of a connector assembly according to an embodiment of the present invention, in which FIG. 1(*a*) is a perspective view of the connector assembly which is exploded into constituent members, and FIG. 1(*b*) is a perspective view showing the entire structure in a state where the constituent members as shown in FIG. 1(*a*) are assembled. In the following description, a direction as shown by an arrow mark A11 in FIG. 1(*a*) is referred to as a longitudinal direction (corresponding to an extending direction of an electric wire), a direction as shown by an arrow mark A12 in FIG. 1(*a*) is referred to as a lateral direction, and a direction as shown by an arrow mark A13 in FIG. 1(*a*) is referred to as a vertical direction. Moreover, a side where a wire-side terminal which will be described below is arranged with respect to the longitudinal direction, in other words, an advancing side of a housing toward a mounting hole which is formed in a casing of the mating device is referred to as a front side, and an opposite side thereto is referred to as a rear side. However, these longitudinal direction, lateral direction and vertical direction need not necessarily correspond to respective directions in a state where the connector assembly is actually mounted on a vehicle (a longitudinal direction, a lateral direction and a vertical direction of the vehicle, for example).

As shown in FIGS. 1(*a*) and 1(*b*), the connector assembly includes a housing 1 in which wire-side terminals 2 are held, and which is fitted to a mounting hole formed in a casing of a mating device to be connected (not shown in the drawings), and a sealing member (hereinafter, referred to as a packing) 3 which is attached to a groove part 16 formed by denting an outer peripheral part 11 of the housing 1 along an entire circumference thereof, and interposed between the groove part 16 (specifically, a groove bottom 16*a*) and an inner peripheral part of the mounting hole thereby to keep an interior of the casing liquid tight. As the mating device to be connected, an electric junction box of a power supply device which is mounted on a vehicle can be supposed. In addition, the connector assembly in this embodiment is provided with a shield shell 4 covering the housing 1 and adapted to be attached to the casing of the mating device to be connected, a shield ring 5 for attaching the shield shell 4 to the housing 1, a holder 7 for allowing electric wires 6 to be held in the housing 1 in a bundled state, rubber plugs 8 attached to end portions 61 of the electric wires 6, and a short-circuiting terminal 9 for short-circuiting the wire-side terminals 2.

The connector assembly is provided on the end portions 61 (tip end portions at a front side in the extending direction) of the electric wires 6. Each of the electric wires 6 includes, for example, an internal conductor covered with an internal insulator, and an external conductor surrounding an outer periphery of the internal insulator and covered with an external insulator coaxially with the internal conductor. The electric wire 6 may be provided with a shield conductor surrounding an outer periphery of the external insulator and covered with a protecting sheath coaxially with the internal conductor and the external conductor. In this case, the internal conductor, the external conductor and the shield conductor may be formed in an arbitrary manner. In this connection, twisted wires can be supposed as the internal conductor, twisted wires or braided wires can be supposed as the external conductor, and braided wires or foils can be supposed as the shield conductor. Moreover, the internal insulator, the external insulator and the protecting sheath may be formed of insulating material (for example, resin such as polyethylene, vinyl chloride, silicone). This electric wire 6 is provided with the rubber plug 8 which is fitted to an outer periphery of the external insulator at a rear side of the end portion 61, so that intrusion of water into the housing 1 from the rear side of the wire 6 (a side to be connected to the inverter of the electric motor) and fall of the wire from the housing may be prevented. Moreover, in this embodiment, the two wires 6 are arranged laterally in a row, and the end portions 61 of the wires 6 are contained in the housing 1. On this occasion, the two wires 6 are bundled into one by the holder 7 leaving a predetermined interval between them, and the end portions 61 of the wires 6 are contained in the housing 1. The holder 7 has such a structure that two cylindrical parts 71 which are covered over the outer peripheries of the external insulators of the wires 6 are coupled together so as to be arranged in a row, leaving a predetermined interval. However, the number of the wires 6 is not particularly limited. For example, only one wire, or three or more wires may be arranged in a row.

Each of the wire-side terminals 2 is formed by removing the external insulator, the external conductor, and the internal insulator from the end portion 61 of the wire 6 to expose the internal conductor, and by press-fitting a terminal metal fitting 21 to an exposed part of the internal conductor. The terminal metal fitting 21 has a press-fitted part 21*a* which is press-fitted to an outer periphery of the exposed part of the internal conductor in the end portion 61 by crimping or so, and a contact part 21*b* which is continued from the press-fitted part 21*a* and extended frontward in a plate-like shape. The contact part 21*b* is provided with a through hole 21*c* passing through the plate-like part in a vertical direction. The device-side terminal which is provided in the mating device to be connected is also provided with a predetermined through hole (not shown) so as to pass in the vertical direction. In this manner, the contact part 21*b* is connected to the device-side terminal, by communicating the through hole 21*c* with the through hole of the device-side terminal, by passing a bolt through the communicated holes, and by tightening the bolt with a nut. In short, the wire-side terminal 2 and the device-side terminal are brought into an electrically connectable state. The wire-side terminals 2 are short-circuited by the short-circuiting terminal 9, until the housing 1 (actually, the connector assembly) is fitted to the mounting hole in the casing of the mating device. After the housing 1 has been fitted to the mounting hole, the wire-side terminals 2 which are short-circuited by the short-circuiting terminal 9 are released by a predetermined short-circuit releasing member.

The shield shell 4 is formed as a member for surrounding the outer peripheral part 11 of the housing 1 thereby to shield connecting parts between the wires 6 and the wire-side terminals 2 (that is, the press-fitted parts 21*a* of the terminal metal fittings 21 which are press-fitted to the end portions 61). The shield shell 4 has a tubular part 41 which is covered over the outer peripheral part 11 of the housing 1 in a manner of surrounding the outer peripheral part 11, a flange part 42 which is extended in a substantially plate-like shape from a front peripheral edge of the tubular part 41 in a lateral direction and in a downward direction, and projecting pieces 43 which are bent frontward from upper parts of both ends in the lateral direction of the flange part 42. The tubular part 41 is covered over the outer peripheral part 11 of the housing 1 in which the end portions 61 of the wires 6 provided with the wire-side terminals 2 are contained, by being inserted from the rear side. Then, the shield ring 5 is mounted to an outer peripheral part of the tubular part 41, and the shield shell 4 is tightened by the shield ring 5 thereby to be attached to the housing 1. The flange part 42 has a dented part 42*a* which is continued from a front opening of the tubular part 41 and extended so as to enlarge the front opening corresponding to the housing 1 (specifically, a shield shell mounting part 13 which will be described below). The projecting pieces 43 are respectively provided with holes 43*a* passing them through in the vertical direction. Then, the flange part 42 is butted against or rightly opposed to a peripheral edge of the mounting hole which is formed in the casing of the mating device, and fastened to the casing with bolts which are passed through the holes 43*a*. In this manner, it is possible to position and fix the housing 1 (actually, the connector assembly) with respect to the mating device by way of the shield shell 4.

The housing 1 is formed as a box member for containing the electric wires, for the purpose of containing terminal holding box members for holding the wire-side terminals 2 (in other words, the end portions 61 of the wires 6 provided with the wire-side terminals 2). In this embodiment, such a case that the housing 1 is molded by injecting resin into a molding cavity is supposed, as an example. In this case, the housing 1 may be formed, for example, by extracting (separating) two molds which are mated from the longitudinal direction or the lateral direction, along the relevant direction. However, material and production method of the housing 1 are not limited to the case.

The housing 1 has a body part 12 for holding the wire-side terminals 2 which are inserted, and the shield shell mounting part 13 for mounting the body part 12 to the shield shell 4. The body part 12 is provided with terminal-holding chambers 14 in a tubular shape for holding the wire-side terminals 2 which are inserted. In this embodiment, the two terminal-holding chambers 14 for respectively holding the two wire-side terminals 2 are provided corresponding to the two wire-side terminals 2 which are connected to the end portions 61 of the two wires 6 one by one. Each of the terminal-holding chambers 14 is provided with a fitting part 14*a* to which the contact part 21*b* of the terminal metal fitting 21 is fitted, near a front opening thereof. In this manner, the contact part 21*b* is inserted into the fitting part 14*a*, and the rubber plug 8 which is attached to the end portion 61 of the wire 6 comes into tight contact with a part of the body part 12 near its rear opening, thereby to hold the wire-side terminal 2 in the terminal-holding chamber 14 (actually, the housing 1). In this case, for example, a lance (not shown) formed of elastic material (an elastically deformable locking piece in a cantilever shape) may be formed on an inner wall of the terminal-holding chamber 14. By engaging the lance with a locking hole or the like which is formed in the contact part 21*b* of the terminal metal fitting 21, it is possible to prevent escape of the wire-side terminal 2 from the terminal-holding chamber 14 (actually, the housing 1).

The wire-side terminal 2 is inserted into the body part 12 having the above described structure from a rear opening of the terminal-holding chamber 14, and the through hole 21*c* of the contact part 21*b* is exposed to the exterior from the front opening (the fitting part 14*a*, as seen from another aspect). In this manner, when the housing 1 is fitted to the mounting hole of the mating device, the through hole 21*c* can be opposed to the device-side terminal of the mating device. In short, the contact part 21*b* of the wire-side terminal 2 is so constructed as to be connectable with the device-side terminal of the mating device. In other words, the housing 1 has such structure that the front part of the body part 12 is formed as a fitting part to be fitted to the mounting hole of the mating device. Moreover, the body part 12 is provided with a short-circuiting terminal connecting part 15 into which the short-circuiting terminal 9 is inserted and connected. The short-circuiting terminal connecting part 15 is provided with an insertion hole 15*a* which is open frontward for allowing the short-circuiting terminal 9 to be inserted. By inserting the short-circuiting terminal 9 into this insertion hole 15*a*, it is possible to connect the short-circuiting terminal 9. Further, a groove part 16 is formed in the outer peripheral part 11 of the body part 12. In this case, a width of the groove part 16 (a size in the longitudinal direction, that is, a distance between a pair of groove walls 16*b*, 16*c* which are opposed to each other interposing a groove bottom 16*a*) and a depth of the groove part 16 (a size from the outer peripheral part 11 to the groove bottom 16*a*) may be set according to a width and a wall thickness of the packing 3 to be attached, in such a manner that the packing 3 can be fitted into the groove part 16, leaving substantially no clearance.

The shield shell mounting part 13 is protruded to both sides in the lateral direction from a substantially intermediate position in the longitudinal direction of the outer peripheral part 11 of the housing 1 (the body part 12). In this case, the shield shell mounting part 13 is protruded so as to be contained in the dented part 42*a* of the flange part 42, and mounted to the shield shell 4, by locking elastically deformable locking hooks 13*a* which are provided at both ends thereof in the lateral direction to locking holes 42*b* which are formed in the dented part 42*a*.

Moreover, in this embodiment, the groove part 16 has a positioning part 17 for positioning the packing 3. The positioning part 17 is formed by denting a wall face of the front groove wall 16*b*, out of a pair of the groove walls 16*b*, 16*c* which are opposed to each other interposing the groove bottom 16*a*, so as to extend frontward in a substantially rectangular shape having a substantially same wall thickness as the packing 3. Further, the positioning part 17 is bent substantially at a right angle from an extended distal end so as to be more dented than the groove bottom 16*a*, as a continuous hole. In this embodiment, as an example, the two positioning parts 17*a*, 17*b* are positioned one by one at substantially intermediate positions in the lateral direction on both sides in the vertical direction of the wall face of the groove wall 16*b* (See FIG. 2(*b*)). A shape, a size, arranging positions and the like of the positioning parts 17 may be set according to a shape, a size, arranging positions and the like of positioning projections 32 which are provided on the packing 3 to be attached, which will be described below.

Figure 2:
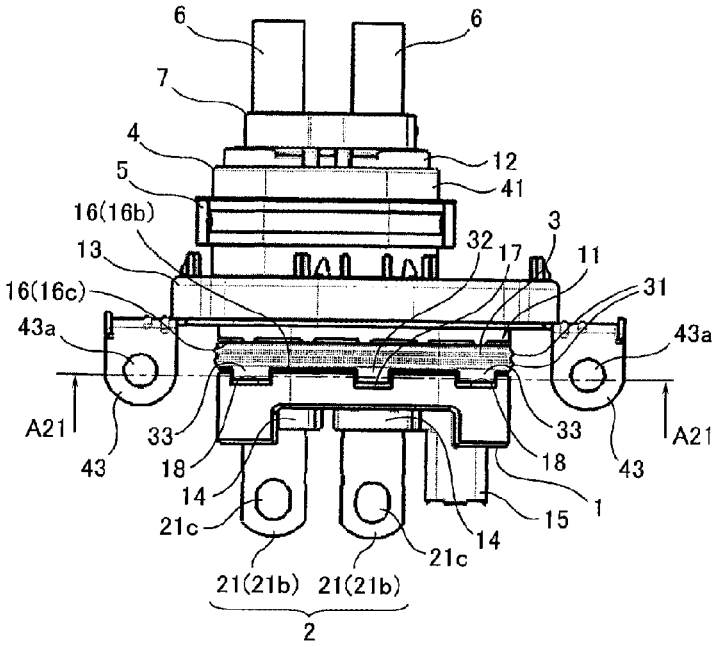
In FIG. 2, (*a*) to (*c*) are diagrams showing structure of a sealing member (a packing) according to an embodiment of the present invention, in which FIG. 2(*a*) is a plan view showing the packing in a state attached to the housing, FIG. 2(*b*) is a vertical sectional view as seen from a direction of an arrow mark A21 in FIG. 2(*a*), and FIG. 2(*c*) is an enlarged view showing an encircled part A22 in FIG. 2(*b*) in an enlarged scale.
Figure 2:
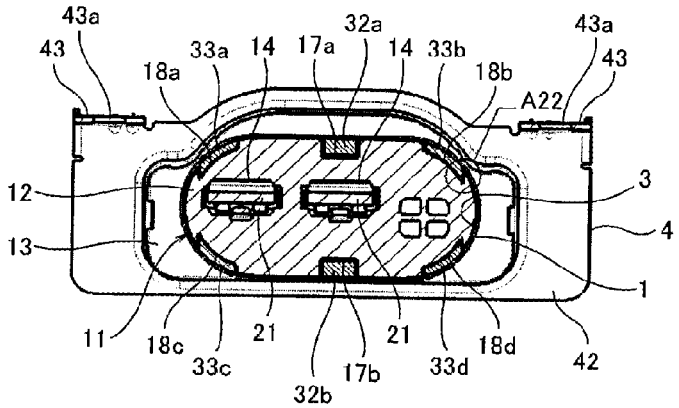
Figure 2:
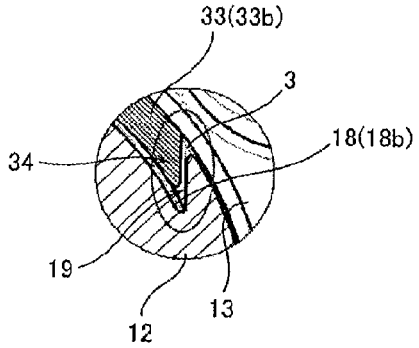

The packing 3 is attached to the groove part 16 of the housing 1 thereby to keep an interior of the casing of the mating device liquid tight. FIGS. 2(*a*) to 2(*c*) show structure of the packing 3 in this embodiment. FIG. 2(*a*) is a plan view showing the packing 3 in a state attached to the groove part 16 of the housing 1, FIG. 2(*b*) is a vertical sectional view as seen from a direction of an arrow mark A21 in FIG. 2(*a*), and FIG. 2(*c*) is an enlarged view showing an encircled part A22 in FIG. 2(*b*) (structures of a protruding part 33 and a protrusion engaging part 18 which will be described below), in an enlarged scale.

The packing 3 as described above is formed in a shape of an annually continued band. An inner peripheral part of the packing 3 is tightly contacted with the groove bottom 16*a* of the groove part 16, and an outer peripheral part thereof is tightly contacted with an inner peripheral part of the mounting hole of the mating device. For this reason, the packing 3 is formed of resin or the like having elasticity (sealing performance). Moreover, in this embodiment, the groove part 16 (actually, the outer peripheral part 11) has a substantially oblong shape (a substantially elliptical shape elongated in the lateral direction) in vertical section, by making short sides of a rectangular shape arc-shaped. Therefore, as an example, the packing 3 is formed in an annular shape having a substantially oblong shape (a substantially elliptical shape) corresponding to the vertical sectional shape of the groove part 16. In this case, the mounting hole of the mating device is also formed in a substantially oblong shape (a substantially elliptical shape). Specifically, an entire shape of the packing 3 is not particularly limited, provided that the entire shape corresponds to the vertical sectional shape of the groove part 16 (the outer peripheral part 11) and an opening shape of the mounting hole. For example, the entire shape may be formed in such a shape that four corners of the elliptical shape or the rectangular shape are convex curved, or in a circular shape, a rectangular shape, etc. Moreover, the packing 3 is provided with two lip portions (ribs in a convex curved shape) 31, in arc-shape curved parts at both sides in the lateral direction of the outer peripheral part. In this manner, the housing 1 (actually, the connector assembly) is fitted to the mounting hole of the mating device, and in a state where the packing 3 is interposed between the groove part 16 and the inner peripheral part of the mounting hole, the lip portions 31 are pressed and tightly contacted with the inner peripheral part of the mounting hole in an elastically deformed state. As results, it is possible to enhance sealing performance between the outer peripheral part of the packing 3 and the inner peripheral part of the mounting hole.

In this embodiment, the packing 3 has positioning projections 32 corresponding to the positioning parts 17 of the groove part 16. The positioning projections 32 are provided in such a manner that a peripheral edge of the packing 3 at the front side is protruded frontward to form protruded parts, and the protruded parts are bent at a substantially right angle so as to extend projecting more than the inner peripheral part of the packing 3. In this case, as an example, the two positioning projections 32*a*, 32*b* are provided on the front side peripheral edge of the packing 3, at both sides in the vertical direction, each one of which is positioned at a substantially intermediate position in the lateral direction. In this manner, the positioning projections 32*a*, 32*b* are fitted into the positioning parts 17*a*, 17*b*, and the packing 3 is fitted into the groove part 16 thereby to be positioned with respect to the groove part 16 (actually, the housing 1). A shape, a size, arranging positions and the like of the positioning projections 32 may be set according to the shape, size, arranging positions and the like of the positioning parts 17 of the groove part 16.

Moreover, the packing 3 is provided with a convex part (hereinafter referred to as a protruding part) 33 which is protruded in a width direction from at least one of the peripheral edges in the curved parts. On the other hand, the groove part 16 has a concave part (hereinafter referred to as a protrusion engaging part) 18 which is formed by denting at least one of the groove walls 16*b*, 16*c* which are opposed to each other interposing the groove bottom 16*a*, in correspondence with the protruding part 33. The protruding part 33 and protrusion engaging part 18 are formed in such a manner that they are engaged with each other in a direction along the curved part of the packing 3. In this embodiment, as an example, the protruding part 33 has a convex engaging end which is so formed as to be tapered in a direction where the protruding part 33 is engaged with the protrusion engaging part 18, while the protrusion engaging part 18 has a concave engaging end which is so formed as to be tapered in a direction where the protrusion engaging part 18 is engaged with the protruding part 33. In this manner, the protruding part 33 and the protrusion engaging part 18 are smoothly and reliably engaged with each other, and can be maintained in the engaged state. Structures of the protruding part 33 and the protrusion engaging part 18 will be described below.

In this embodiment, as an example, the packing 3 is provided with the four protruding parts 33, which are positioned one by one in the curved parts in an arc shape (R-parts) at the laterally opposite ends, at both sides in the vertical direction. In this case, the two protruding parts 33 (the protruding parts 33*a*, 33*b* as shown in FIG. 2(*b*)) which are positioned in an upper part of the packing 3 are protruded so as to extend frontward (in a width enlarging direction) from the upper peripheral edge at the front side of the packing 3. Specifically, each of the protruding parts 33*a*, 33*b* has a substantially rectangular shape which is curved in vertical section, and a lower end of the curved part (a convex engaging end 34 in FIG. 2(*c*), as an example) is tapered downward, that is, in a direction where the protruding part 33*a*, 33*b* is engaged with the protrusion engaging part 18*a*, 18*b*. On the other hand, the two protruding parts 33 (the protruding parts 33*c*, 33*d* as shown in FIG. 2(*b*)) which are positioned in a lower part of the packing 3 are protruded so as to extend frontward (in the width enlarging direction) from the lower peripheral edge at the front side of the packing 3. Specifically, each of the protruding parts 33*c*, 33*d* has a substantially rectangular shape which is curved in vertical section, and an upper end of the curved part (the convex engaging end) is tapered upward, that is, in a direction where the protruding part 33*c*, 33*d* is engaged with the protrusion engaging part 18*c*, 18*d*. The convex engaging ends of the protruding parts 33*a*, 33*c*, 33*d* have the same structure as the convex engaging end 34 of the protruding part 33*b*, as shown in FIG. 2(*c*), although they are different in directions of the taper and directions in the lateral direction.

On the other hand, the protrusion engaging parts 18 are formed in the groove part 16 of the housing 1. In this embodiment, as an example, the protrusion engaging parts 18 are provided at four positions of the groove part 16 corresponding to the four protruding parts 33 which are provided on the packing 3, one by one in the curved parts in an arc shape (R-parts) at the laterally opposite ends, at both sides in the vertical direction. In this case, the two protrusion engaging parts 18 (the protrusion engaging parts 18*a*, 18*b*, as shown in FIG. 2(*b*)) which are positioned in an upper part of the groove part 16 are formed in such a manner that the front groove wall 16*b* out of a pair of the groove walls 16*b*, 16*c* which are opposed interposing the groove bottom 16*a* is dented frontward in a concave shape. Specifically, each of the protrusion engaging parts 18*a*, 18*b* has a substantially rectangular shape which is curved in vertical section, and a lower end of the curved part (a concave engaging end 19 as shown in FIG. 2(*c*), as an example) is tapered downward having substantially the same size as the protruding part 33*a*, 33*b*, that is, in a direction where the protrusion engaging part 18*a*, 18*b* is engaged with the protruding part 33*a*, 33*b*. On the other hand, the two protrusion engaging parts 18 (the protrusion engaging parts 18*c*, 18*d* as shown in FIG. 2(*b*)) which are positioned in a lower part of the groove part 16 are formed by denting a wall face of the groove wall 16*b* frontward. Specifically, each of the protrusion engaging parts 18*c*, 18*d* has a substantially rectangular shape which is curved in vertical section, and an upper end of the curved part (a concave engaging end) is tapered upward having substantially the same size as the protruding parts 33*c*, 33*d*, in a direction where the protrusion engaging part 18 is engaged with the protruding parts 33*c*, 33*d*. The concave engaging ends of the protrusion engaging parts 18*a*, 18*c*, 18*d* have the same structure as the concave engaging end 19 of the protrusion engaging part 18*b*, as shown in FIG. 2(*c*), although they are different in directions of the taper and directions in the lateral direction. Therefore, the protrusion engaging part 18 is so constructed as to be engaged with the protruding part 33, in a direction along the curved part in an arc shape of the packing 3 (in the vertical direction in the structure as shown in FIG. 2(*b*)).

In this embodiment, when the packing 3 is attached to the groove part 16, a force (an expanding force) in the vertical direction is applied to the packing 3 thereby to elastically deform the packing 3, and the positioning projections 32 are fitted into the positioning parts 17. Then, by releasing the expanding force, the packing 3 is elastically deformed to be restored thereby to be fitted into the groove part 16. In this manner, it is possible to attach the packing 3, by positioning the packing 3 with respect to the groove part 16 (actually, the housing 1). At the same time, the packing 3 is attached to the groove part 16, in a state where the protruding parts 33 and the protrusion engaging parts 18 (actually, the convex engaging ends and the concave engaging ends) are engaged with each other.

In the state where the protruding parts 33 are respectively engaged with the protrusion engaging parts 18, as described above, in case where a force in a circumferential direction (a rotation force) is exerted on the packing 3, the rotation force is loaded by the engagement between the protruding parts 33 and the protrusion engaging parts 18. Specifically, the rotation force is loaded vertically along the circumferential direction, because the protruding parts 33*a*, 33*b*, 33*c*, 33*d* and the protrusion engaging parts 18*a*, 18*b*, 18*c*, 18*d* are engaged with each other. Therefore, for example, in case where a worker happens to touch the packing 3, on occasion of fitting the housing 1 (actually, the connector assembly) to the mounting hole of the mating device, and the rotation force is exerted on the packing 3, the rotation force can be loaded by the engagement between the protruding parts 33 and the protrusion engaging parts 18. Accordingly, it is possible to efficiently prevent the packing 3 from rotating in the circumferential direction with respect to the housing 1. As results, it is possible to reliably avoid such phenomenon that the packing 3 is displaced from the groove part 16 and runs upon the housing 1, the packing 3 is entangled when the housing 1 is fitted to the mounting hole, and damage such as a break occurs. Specifically, when the housing 1 is fitted to the mounting hole, tight contact of the packing 3 with respect to the groove part 16 and the inner peripheral part of the mounting hole can be made uniform in the circumferential direction, and enhancement of the sealing performance can be achieved.

The shapes, sizes, arranging positions and the like of the protruding parts 33 and the protrusion engaging parts 18 can be optionally set, provided that they can be engaged with each other. For example, in this embodiment, the protruding parts 33 of the packing 3 are formed in a convex shape, and the protrusion engaging parts 18 of the groove part 16 are formed in a concave shape. However, to the contrary, it is also possible to provide the protruding parts in a convex shape in the groove part 16, and to provide the protrusion engaging parts in a concave shape in the packing 3. Alternatively, these protruding parts and the protrusion engaging parts may be mixed in the packing 3 and in the groove part 16. Moreover, in this embodiment, the protruding parts 33 are provided at the front side of the packing 3, and the protrusion engaging parts 18 are provided at the front side of the groove part 16. However, it is also possible to suppose that the protruding parts and the protrusion engaging parts are provided at the rear side of the packing 3 and the groove part 16, and that they are provided both at the front side and the rear side. Moreover, in this embodiment, both of the convex engaging ends of the protruding parts 33 and the concave engaging ends of the protrusion engaging parts 18 are formed in a taper shape. However, the convex engaging ends and the concave engaging ends may be formed in a convex curved shape in vertical section, like the convex engaging end 34 and the concave engaging end 19 as shown in FIG. 2(*c*) or in a pointed shape. Alternatively, it is also possible to suppose such a structure that the convex engaging ends and the concave engaging ends are formed in a substantially trapezoidal shape in vertical section, such a structure that inclined portions of the trapezoidal shape are formed in a convex curved shape, and such a structure that the convex engaging ends and the concave engaging ends are formed in a rectangular shape or bifurcated shape.

As described above, according to the connector assembly of the present invention, it is possible to reliably restrain the rotation of the packing 3 with respect to the housing 1 in the circumferential direction, thereby to enhance the sealing performance in the connector assembly.

Now, characteristics of the connector assembly in the embodiment according to the present invention will be briefly summarized and described below in items [1] to [2].

[1] A connector assembly in which a wire-side terminal 2 provided on an end portion 61 of an electric wire 6 is electrically connected to a device-side terminal provided on a mating device to which the electric wire 6 is to be connected, the connector assembly including a housing 1 in which the wire-side terminal 2 is held, and which is fitted to a mounting hole formed in a casing of the mating device, and a sealing member (a packing) 3 which is attached to a groove part 16 formed by denting an outer peripheral part 11 of the housing 1 along an entire circumference and interposed between the groove part 16 and the inner peripheral part of the mounting hole thereby to keep an interior of the casing liquid tight, wherein the sealing member (the packing) 3 is formed in a shape of an annularly continued band and provided with a convex part (a protruding part) 33 which is formed in a curved part, by protruding laterally from at least one peripheral edge, the groove part 16 includes a concave part (a protrusion engaging part) 18 which is formed by denting at least one of groove walls 16*b* and 16*c* opposed to each other interposing a groove bottom 16*a* in correspondence with the convex part (the protruding part) 33, and the convex part (the protruding part) 33 and the concave part (the protrusion engaging part) 18 are so formed to be engaged with each other in a direction along the curved part of the sealing member (the packing) 3.

[2] A connector assembly having the structure as described above in the configuration [1], wherein the convex part (the protruding part) 33 includes a convex engaging end 34 which is tapered in a direction where the convex part 33 is engaged with the concave part (the protrusion engaging part) 18, and the concave part (the protrusion engaging part) 18 includes a concave engaging end 19 which is tapered in a direction where the convex part (the protruding part) 33 is engaged with the concave part (the protrusion engaging part) 18.

This application is based on Japanese Patent Application No. 2012-249021 filed on Nov. 13, 2012, the contents of which are incorporated herein by reference.

INDUSTRIAL APPLICABILITY

According to the connector assembly of the present invention, it is possible to reliably restrain the rotation of the packing with respect to the housing in the circumferential direction, thereby to enhance the sealing performance in the connector assembly.

REFERENCE SIGNS LIST

1: Housing
2: Wire-side terminal
3: Packing (sealing member)
6: Electric wire
11: Outer peripheral part
16: Groove part
16*a*: Groove bottom
16*b*, 16*c*: Groove wall
18: Protrusion engaging part (concave part)
33: Protruding part (convex part)
61: End portion

The invention claimed is:

1. A connector assembly in which a wire-side terminal provided on an end portion of an electric wire is electrically connected to a device-side terminal provided on a mating device to which the electric wire is connected, the connector assembly comprising:

a housing in which the wire-side terminal is held, and which is fitted to a mounting hole formed in a casing of the mating device; and a sealing member which is fitted to a groove part formed by denting an outer peripheral part of the housing along its entire circumference, and interposed between the groove part and an inner peripheral part of the mounting hole for keeping an interior of the casing liquid tight, wherein the sealing member is formed in a shape of an annularly continued band, and provided with a convex part which is formed in a curved part thereof, by protruding from at least one peripheral edge in a width direction, the groove part includes a concave part which is formed by denting at least one of groove walls which are opposed to each other interposing a groove bottom in correspondence with the convex part, and the convex part and the concave part are so formed to be engaged with each other in a direction along the curved part of the sealing member.

2. The connector assembly according to claim 1, wherein the convex part includes a convex engaging end which is tapered in a direction where the convex part is engaged with the concave part, and the concave part includes a concave engaging end which is tapered in a direction where the convex part is engaged with the concave part.

* * * * *